US007836799B2

(12) United States Patent
Frank

(10) Patent No.: US 7,836,799 B2
(45) Date of Patent: Nov. 23, 2010

(54) TOOL ASSEMBLY

(75) Inventor: Jeffrey Frank, 944 Old Corbit Rd., Middletown, DE (US) 19709

(73) Assignee: Jeffrey Frank, Middletown, DE (US)

( * ) Notice: Subject to any disclaimer, the term of this patent is extended or adjusted under 35 U.S.C. 154(b) by 57 days.

(21) Appl. No.: 11/417,576

(22) Filed: May 4, 2006

(65) Prior Publication Data

US 2006/0254392 A1 Nov. 16, 2006

Related U.S. Application Data

(60) Provisional application No. 60/678,262, filed on May 6, 2005, provisional application No. 60/712,067, filed on Aug. 29, 2005.

(51) Int. Cl.
*B25B 13/06* (2006.01)
*B25G 1/10* (2006.01)

(52) U.S. Cl. ..... 81/121.1; 81/177.1

(58) Field of Classification Search ..... 81/177.1, 81/177.4, 177.85, 121.1, 119
See application file for complete search history.

(56) References Cited

U.S. PATENT DOCUMENTS

| | | | | | |
|---|---|---|---|---|---|
| 122,787 | A | | 1/1872 | Taft | |
| 2,635,661 | A | * | 4/1953 | Egan | 81/490 |
| 4,336,729 | A | | 6/1982 | Eppenbach | |
| 4,506,889 | A | * | 3/1985 | Lewis | 463/47.4 |
| 4,631,770 | A | * | 12/1986 | Goldberg | 7/167 |
| 4,672,745 | A | * | 6/1987 | Wilkens | 30/340 |
| 4,738,169 | A | | 4/1988 | Wyka | |
| 5,263,389 | A | * | 11/1993 | Frazzell et al. | 81/124.3 |
| 5,601,003 | A | * | 2/1997 | Amtenbrink et al. | 81/489 |
| 5,806,380 | A | | 9/1998 | Wilsey | |
| 5,865,077 | A | * | 2/1999 | Moffitt et al. | 81/427.5 |
| 5,937,473 | A | * | 8/1999 | Lisowski | 15/236.08 |
| 6,202,518 | B1 | * | 3/2001 | Moffitt et al. | 81/427.5 |
| 6,336,731 | B1 | * | 1/2002 | Chien | 362/120 |
| 6,592,219 | B1 | * | 7/2003 | Tsai | 351/42 |
| 6,726,516 | B2 | * | 4/2004 | Sowry et al. | 441/1 |
| 6,739,224 | B1 | * | 5/2004 | Wershe | 81/437 |
| 7,073,918 | B1 | * | 7/2006 | Bauman | 362/119 |
| 7,162,802 | B2 | * | 1/2007 | Benardeau et al. | 30/147 |
| 2002/0139225 | A1 | | 10/2002 | Carter | |
| 2004/0261585 | A1 | * | 12/2004 | Birns | 81/125.1 |

(Continued)

FOREIGN PATENT DOCUMENTS

DE 3734016 A1 4/1989

(Continued)

OTHER PUBLICATIONS

Notification of Transmittal of the International Search Report and Written Opinion for corresponding PCT application No. PCT/US2006/017256.

(Continued)

*Primary Examiner*—David B Thomas
(74) *Attorney, Agent, or Firm*—Potter Anderson & Corroon LLP; Travis W. Bliss

(57) ABSTRACT

A tool assembly comprising a tool having a distal end and a proximal end having a protrusion thereon; and a device coupled with the proximal end of the tool, wherein the device is capable of accommodating a tool and has a compartment for storing various items.

12 Claims, 13 Drawing Sheets

U.S. PATENT DOCUMENTS

2006/0053985 A1* 3/2006 Chen ..... 81/489

FOREIGN PATENT DOCUMENTS

DE 19628901 C1 1/1998
DE 20004376 U1 5/2000
DE 20215018 U1 12/2002
EP 1393862 A2 3/2004

OTHER PUBLICATIONS

Hebert, Jim, continuous wave.com/whaler/reference/13/originalHullDesign.html, Original Design and Conception of the 13-Foot Whaler Hull, pp. 1-7, Feb. 2000.

* cited by examiner

TOOL ASSEMBLY

CROSS-REFERENCE TO RELATED APPLICATIONS

This application claims priority from U.S. Provisional Application Nos. 60/678,262, filed May 6, 2005, and 60/712,067, filed Aug. 29, 2005, both of which are incorporated by reference herein in their entireties.

BACKGROUND OF THE INVENTION

Typically, recreational boats have simple drainage systems, where accumulated water (i.e. water in the boat's interior resulting from rain, splash-over, and/or run-off from wet clothing and equipment) drains into a bilge area, which is usually located in the rear portion of the boat's hull or transom. Boats are generally designed to allow the accumulated water to exit the bilge area via a pathway extending from the bilge, through the transom and emptying into the water or onto the ground once the boat is out of the water. Typically this pathway is blocked using a drainage plug to prevent the back-flow of water into the bilge area and ultimately into the remainder of the boat. In general, the drainage plug may be either mechanically or manually engaged or disengaged. The drainage plug is optimally engaged and/or disengaged while the boat is in dry-dock or otherwise out of the water, for example on a boat lift above the water or on a trailer. Difficulties arise when engaging or disengaging the drain plug when the boat is out of the water because any tools used in conjunction with the drainage plug may be dropped and lost and/or forgotten at home.

Thus, a heretofore unaddressed need exists in the industry to provide a versatile tool to address the aforementioned deficiencies and inadequacies.

SUMMARY OF THE INVENTION

Briefly described, embodiments of the tool assembly, among others, can be implemented as described herein. An embodiment of the present invention is a tool assembly comprising a tool having a proximal end and a distal end; and a device coupled with the proximal end of the tool.

Another embodiment of the present invention relates to a tool assembly capable of floating.

Another embodiment of the present invention relates to use of the tool assembly as a keychain.

A further embodiment of the present invention relates to a device for engaging a boat drainage plug comprising a body having a proximal end and a closed distal end opposite said proximal end; and, disposed in the proximal end, a socket capable of functionally engaging a boat drainage plug.

Other features and advantages of the embodiments of the present invention will be or become apparent to one skilled in the art upon examination of the following drawings and detailed description. It is intended that all such additional features and advantages be included within this description, be within the scope of the present invention, and be protected by the accompanying claims.

BRIEF DESCRIPTION OF THE DRAWINGS

Many aspects of the embodiments of the present invention can be more fully understood with reference to the following drawings. The components set forth in the drawings are not necessarily to scale. Moreover, in the drawings, the reference numerals designate corresponding parts throughout the several views.

DETAILED DESCRIPTION

Figure 1:
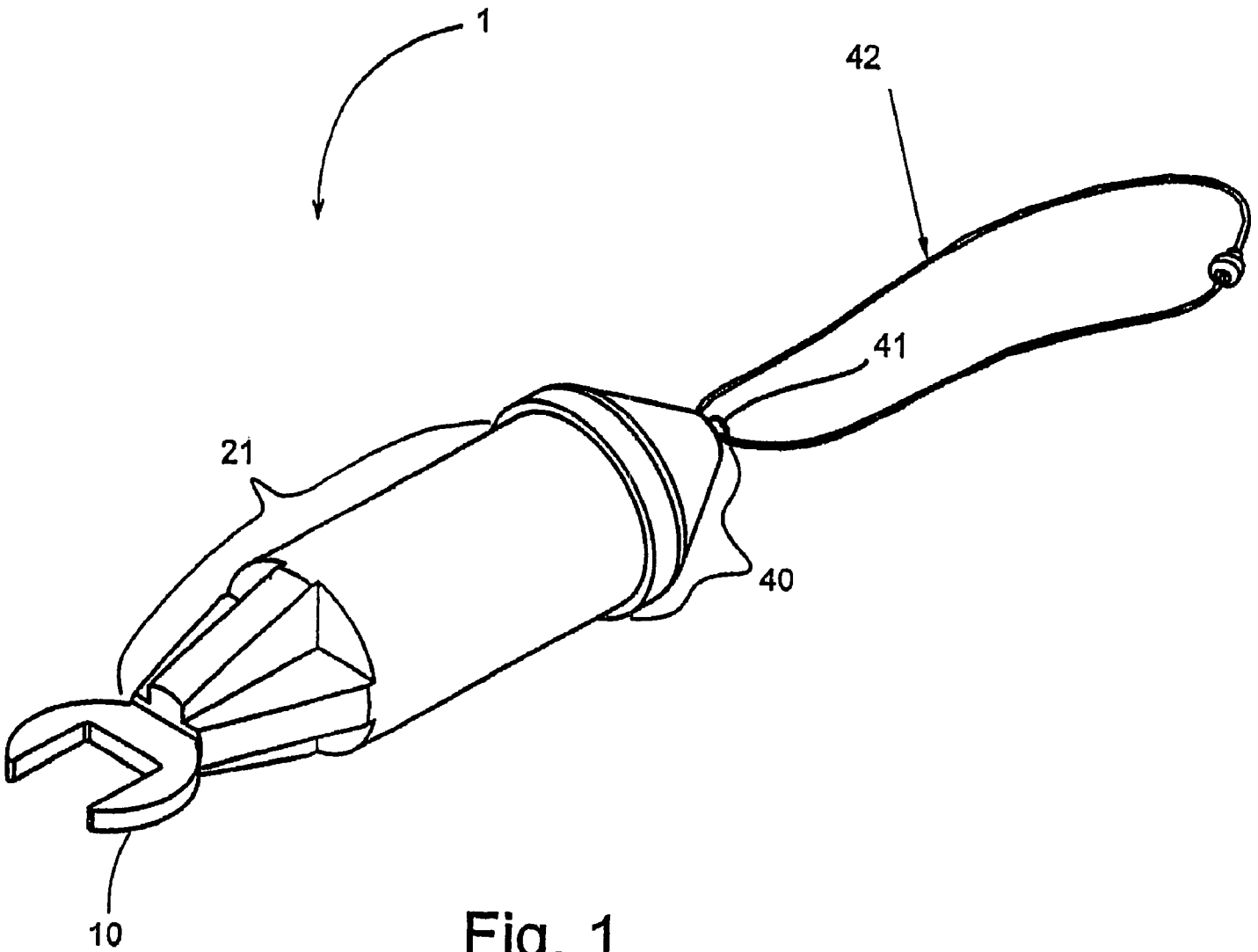
FIG. 1 is a perspective view of an embodiment of the present invention.
Figure 2A:
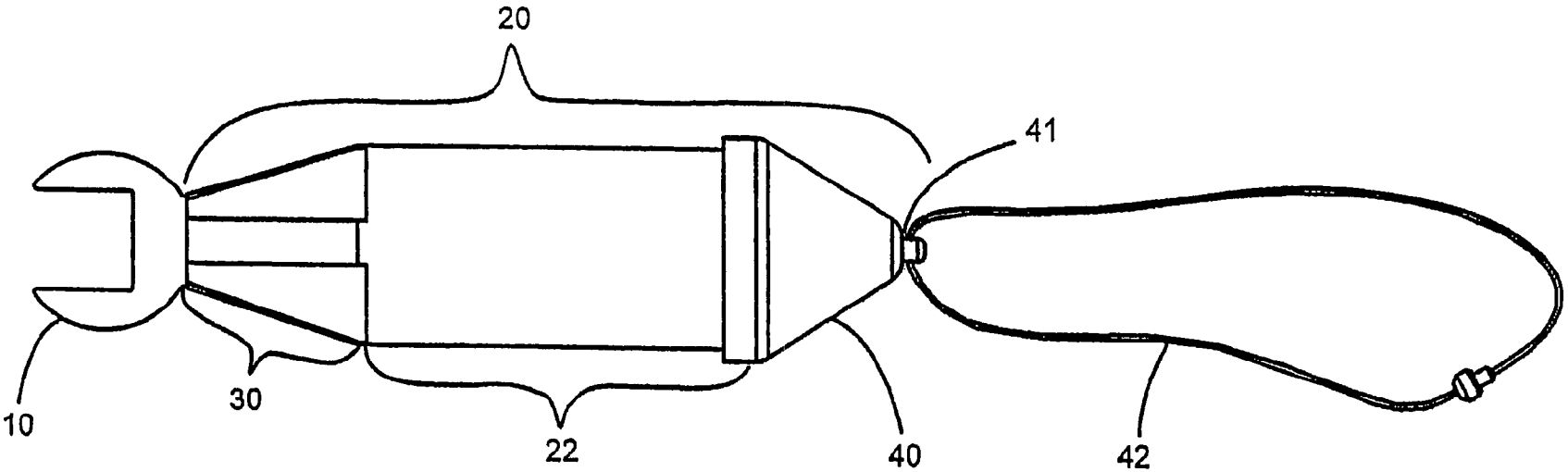
FIG. 2A is a side view of an embodiment of the present invention.
Figure 2B:
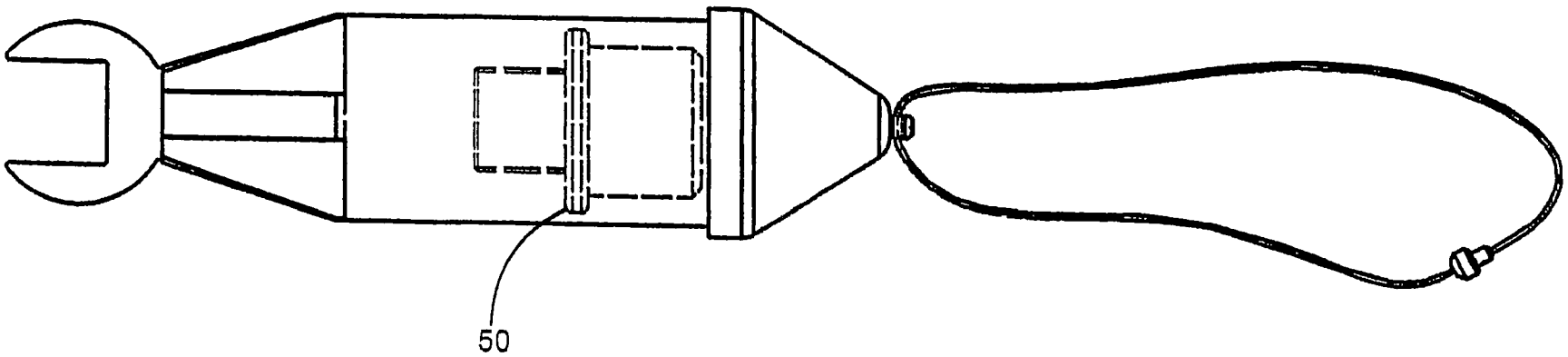
FIG. 2B is a side view of an embodiment of the present invention including a drain plug contained therein.

The embodiments of the present invention described herein provide a versatile tool assembly (preferably capable of floating in water) to assist boat operators in the installation and subsequent removal of conventional boat drainage plugs. While the present invention is described with respect to its use in boating, the various embodiments of the tool assembly can also be used in a wide range of recreational and industrial arenas where it may contain a variety of items.

FIGS. 1-5 show an embodiment of the present invention is a tool assembly (1) comprising:

(a) a tool (10) having a proximal end (12) and a distal end (11); and (b) a device (20) coupled with the proximal end (12) of the tool.

Figure 10:
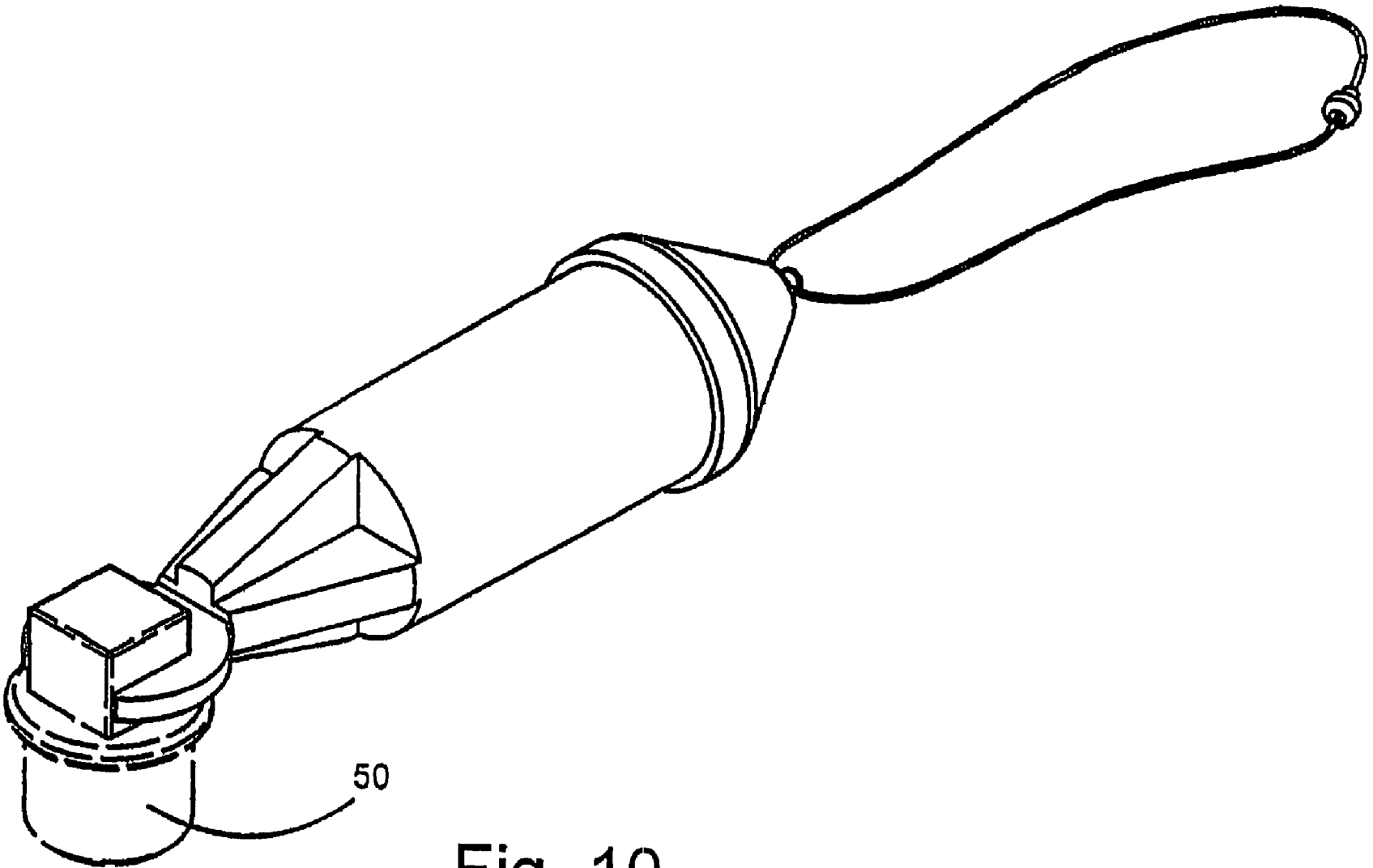
FIG. 10 is a perspective view of an embodiment of the present invention engaged with a drainage plug.

The tool (10) for use in conjunction with the embodiments of the present invention may be any typically found to have use on a boat including, but not limited to, wrenches and screwdrivers (i.e. both phillips head and flat head). Preferably, the tool is a wrench capable of use with a conventional and commercially available boat drainage plug (50) (e.g. as shown in FIG. 10). Most preferably, when utilizing a wrench, the wrench measures 9/16ths of an inch.

Typically the tool (10) may be constructed of any material capable of withstanding the stresses and strains generated and encountered during normal use. Preferably, the material comprises a non-corrosive material, more preferably a non-corrodible and non-marking material. Examples of suitable materials include, but are not limited to, metals (preferably stainless steel or galvanized steel), plastics (preferably hard plastics such as PVC (polyvinyl chloride)); and wood (preferably teak). The tool (10) may also be constructed of any combination of these materials. Suitable materials and/or combinations of materials for the tool are well known to those skilled in the art.

Figure 3:
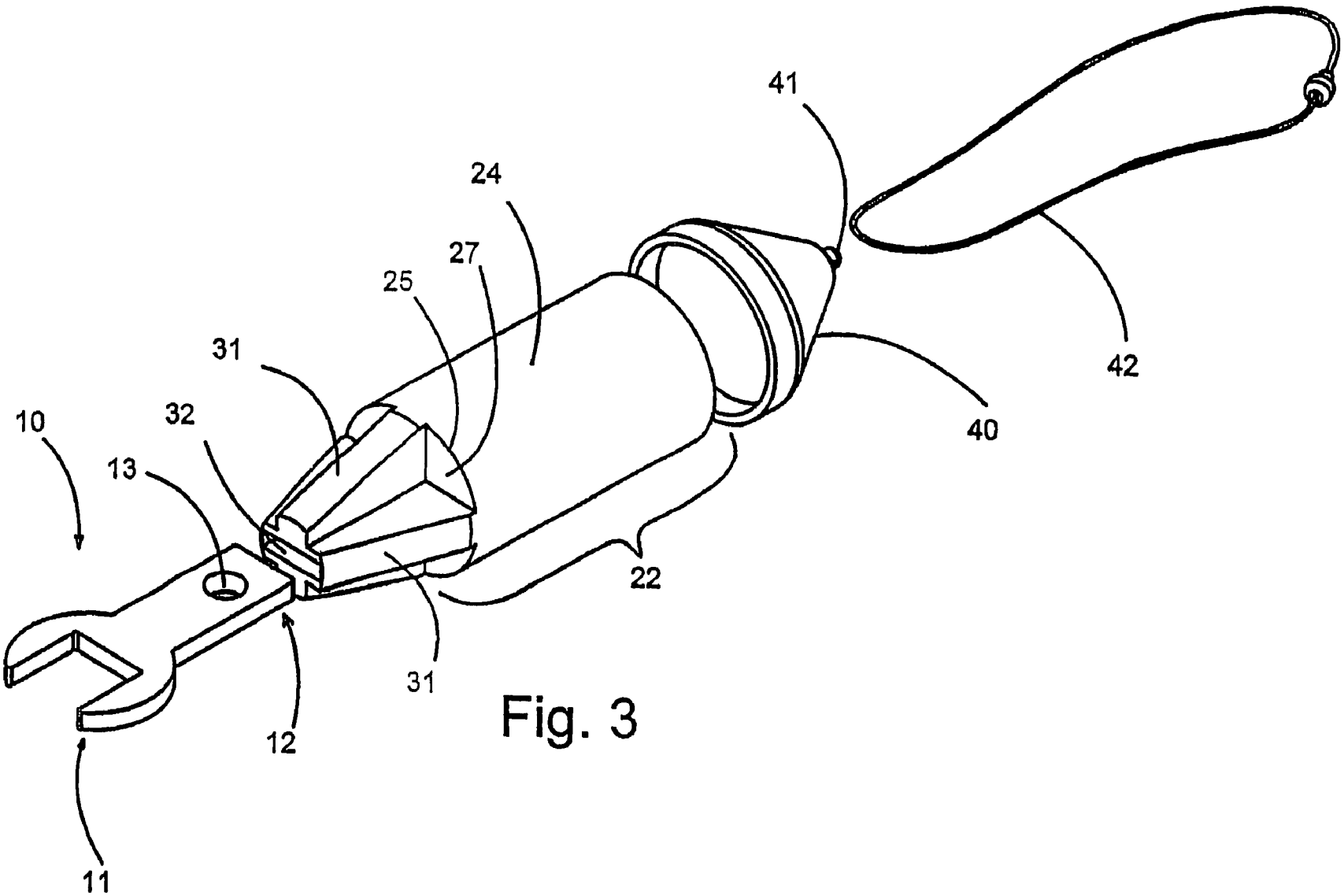
FIG. 3 is an exploded perspective view of an embodiment of the present invention.
Figure 4:
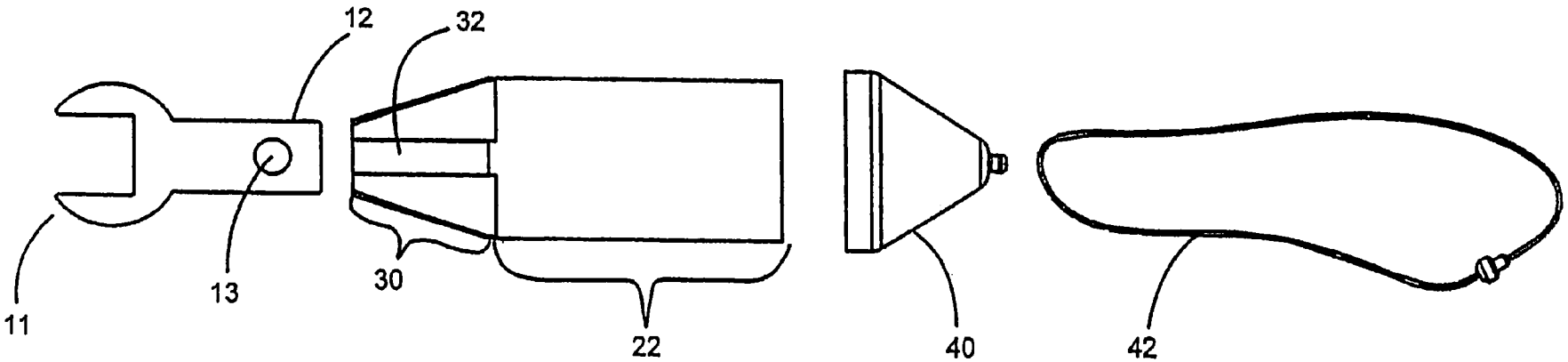
FIG. 4 is an exploded side view of an embodiment of the present invention.
Figure 5:
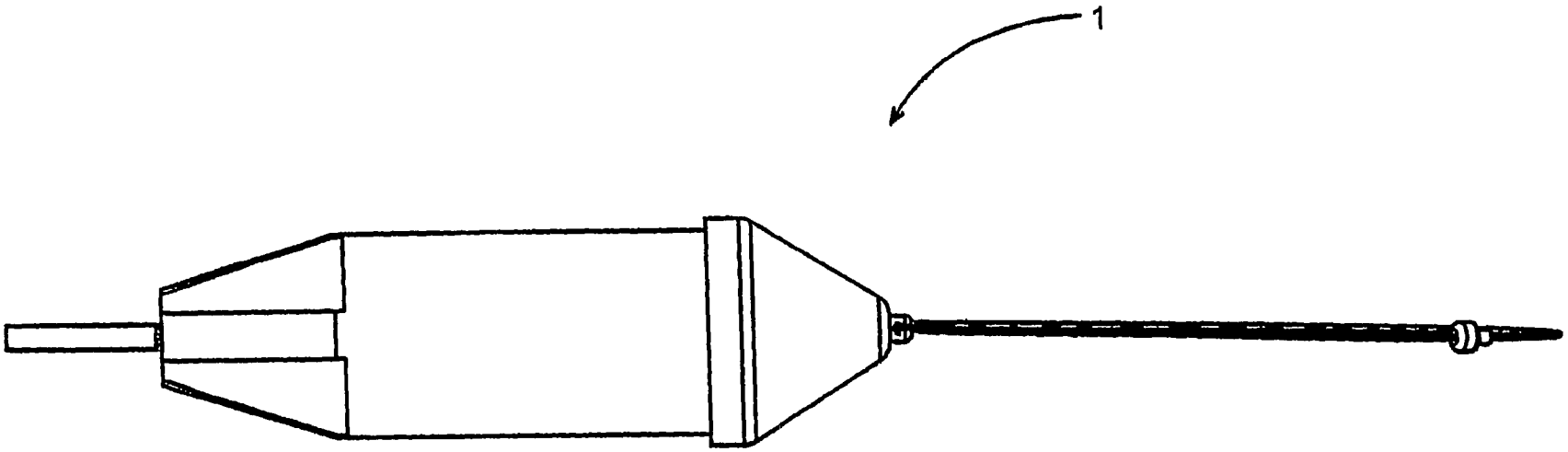
FIG. 5 is a top view of an embodiment of the present invention.
Figure 6:
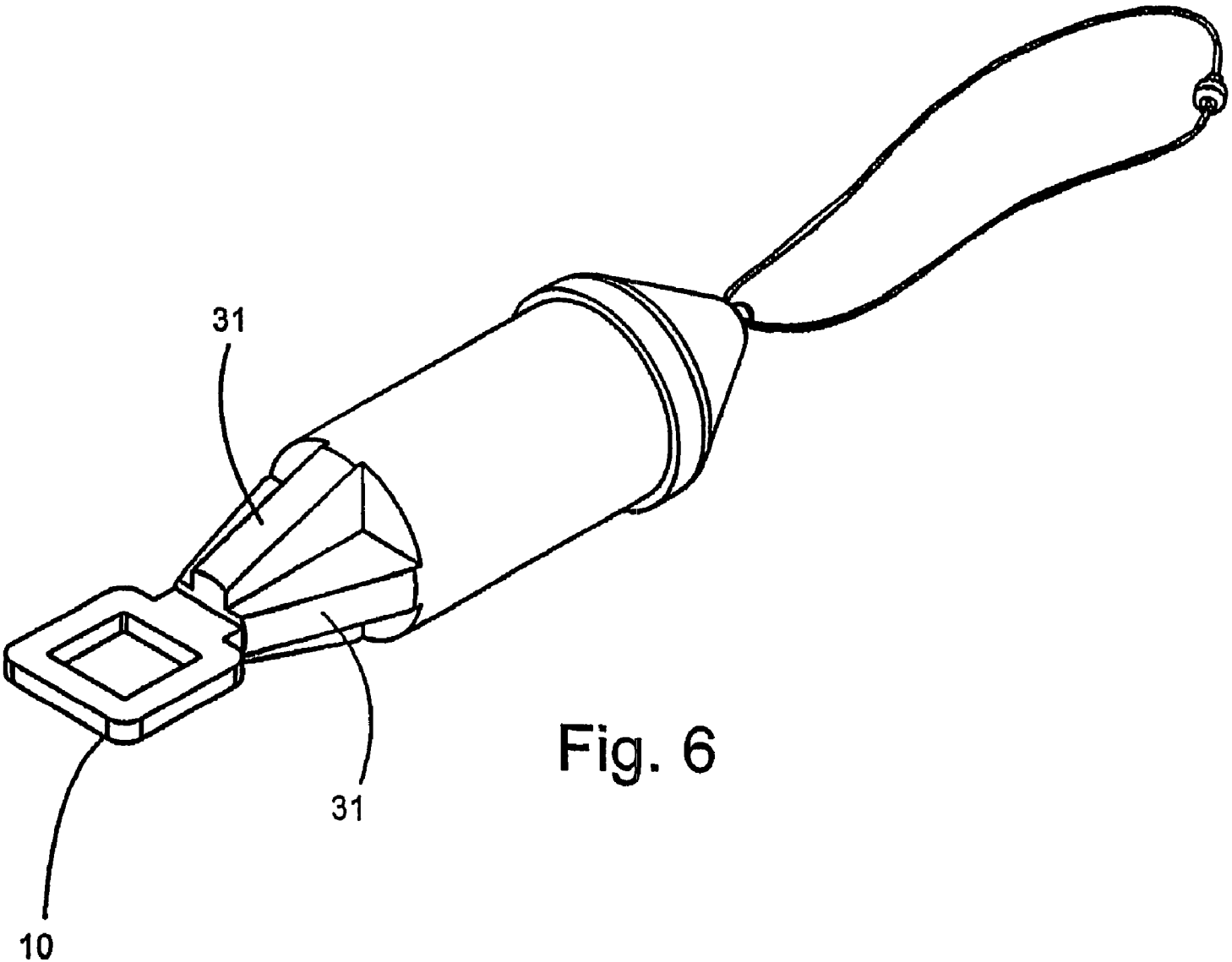
FIG. 6 is a perspective view of an alternate embodiment of the present invention.
Figure 7:
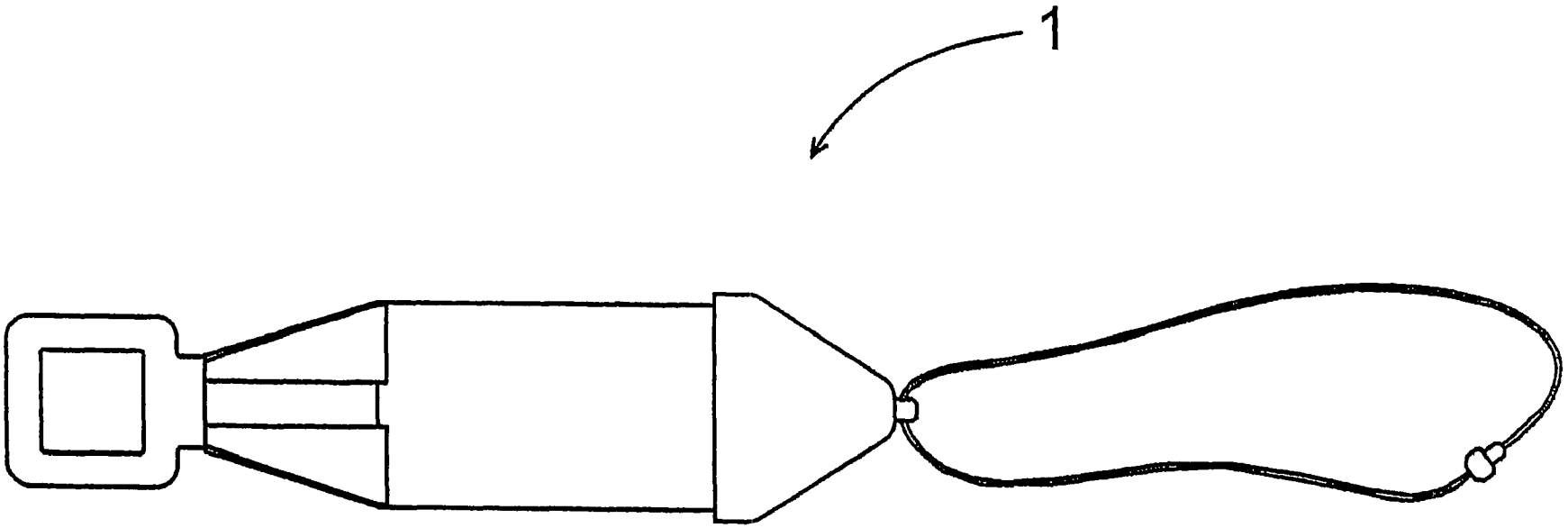
FIG. 7 is a top view of an alternate embodiment of the present invention.
Figure 11:
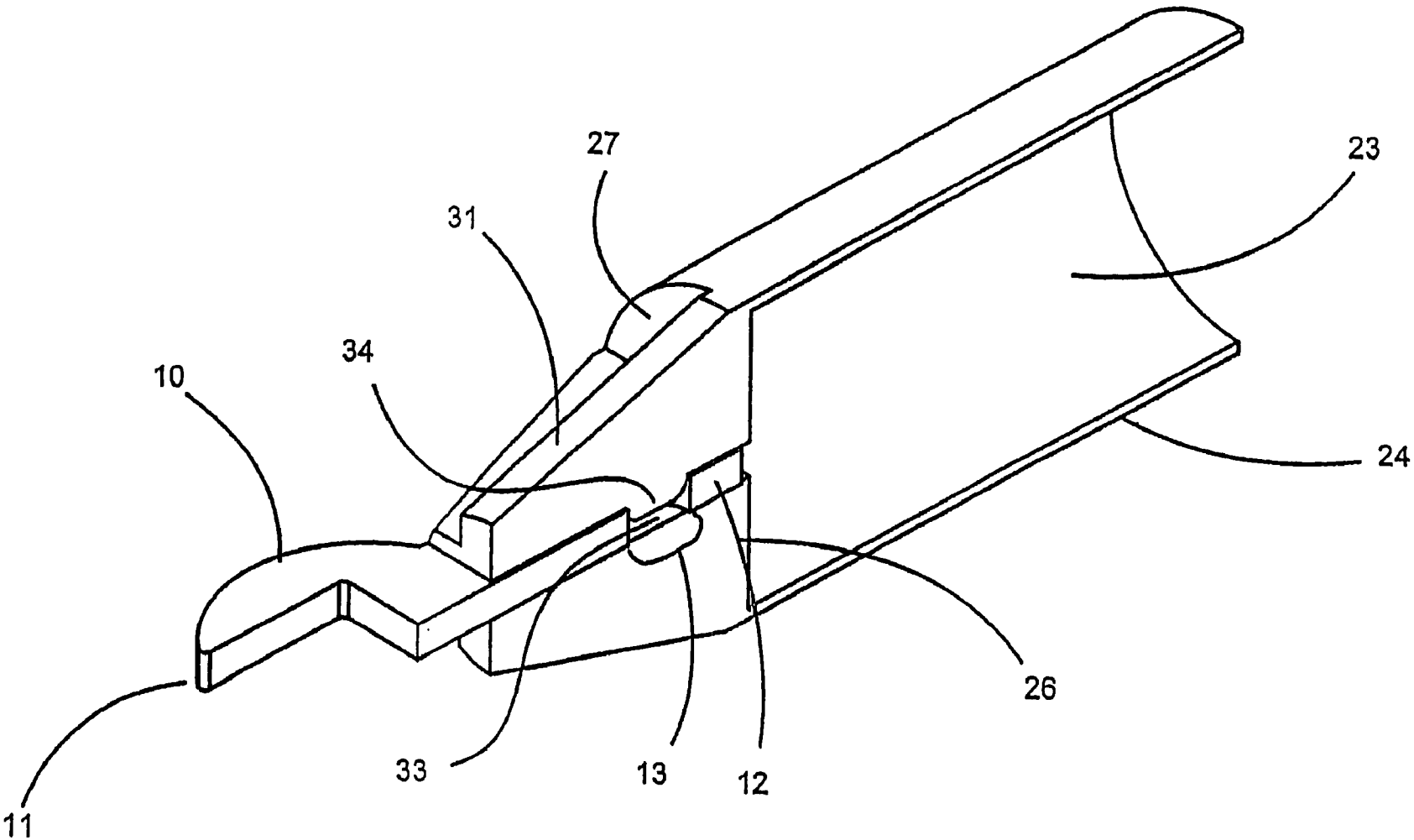
FIG. 11 is a longitudinal cross-sectional view of a portion of the present invention.

The tool (10) may be coupled and secured to the device (20) using any method known in the art. Preferably, the tool (10) has an aperture, depression or other type of indentation (13) located at substantially its proximal end (12) (e.g. preferably a molded pin snap as shown in FIG. 11), which allows the tool (10) to be inserted into and secured with the device (20), as shown in FIG. 3. The aperture, depression or other type of indentation (13) should be of a size and positioning to substantially accommodate the protrusion (34) found on the cavity surface (33). Alternatively, the opposite configuration may also be utilized where the protrusion is found on the proximal end (12) of the tool (10) and the aperture, depression or other type of indentation (13) may be located in the cavity surface (33). As a result, the embodiments of the present invention provide for the tool assembly (1) to have a wide variety of tools that may be affixed thereto.

Embodiments of the device (20) may either be a unitary structure, or in the alternative, a two-piece structure comprising a body (21) having a tool-receiving end (30) and a containment end (22) such that a storage area (a.k.a. compartment) (23) exists; and an enclosing device (40) for the containment end. Preferably, the device (20) has a two-piece structure.

Figure 12:
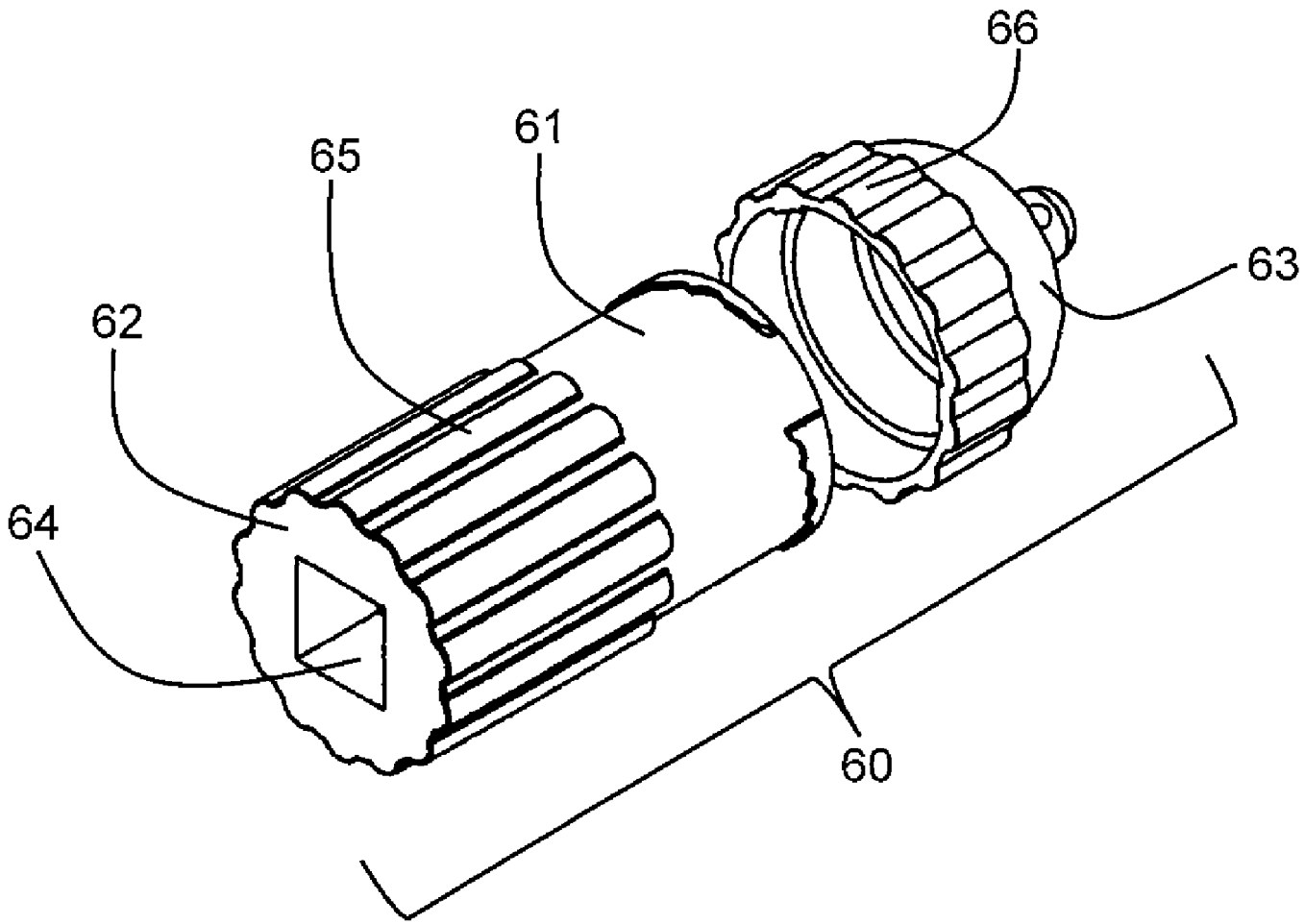
FIG. 12 is a perspective view of an alternate embodiment of the present invention.

In another embodiment (FIG. 12), the device (60) comprises a body (61) having a proximal end (62), preferably a substantially blunt proximal end, and a closed distal end opposite said proximal end (63), and, disposed on the proximal end, a socket (64) capable of functionally engaging a boat drainage plug. By "functionally engaging" is meant that the socket, when engaged with a boat drainage plug, can rotate, with appropriate user input (e.g., torquing of the device), the drainage plug clockwise or counterclockwise in such a way as to remove the drainage plug from or attach the drainage plug to the drain. By "closed distal end" is meant that the exterior of the end opposite from the substantially blunt proximal end does not have an opening or a cavity. However, "closed distal end" is not meant to exclude two-piece embodiments described above because the opening thereof is interior to the device.

In a preferred embodiment of the device (60), the socket (64) is substantially square. More preferably, the socket (64) is substantially square and sized to fit a $9/16^{th}$ drain plug.

Typically the device (20, 60) may be constructed of any material, wherein these materials are capable of providing the structural integrity and rigidity necessary to withstand the stresses and strains generated and encountered during normal use. Preferably, the material comprises a non-corrodible material, more preferably a non-corrodible and non-marking material. Examples of suitable materials include, but are not limited to, plastics (preferably hard plastics such as PVC (polyvinyl chloride)), wood (e.g. oak, maple, pine etc.) or metals (e.g. stainless steel, aluminum and steel). The device (20, 60) may also be constructed of any combination of these materials. Suitable materials and/or combinations of materials for the device (20, 60) are well known to those skilled in the art.

With respect to the preferred embodiment of the present invention capable of floating, it is capable of doing so when the tool is affixed to the device and when the boat drain plug is removed from the compartment (23) and inserted into its proper position on the boat. Typically with the floating embodiment of the present invention, the device (20, 60) may be constructed of any buoyant material, combination of buoyant materials or any material where after the containment end (22) is enclosed the floating device (20, 60) is rendered buoyant, wherein these materials are capable of providing the structural integrity and rigidity necessary to withstand the stresses and strains generated and encountered during normal use. These buoyant materials and/or combinations thereof are well known to those skilled in the art. Preferably, the material comprises a non-corrodible material, more preferably a non-corrodible and non-marking material capable of floating even when extraneous items are contained therein. Examples of suitable materials include, but are not limited to, plastics (preferably hard plastics such as PVC (polyvinyl chloride)); and wood (preferably teak). A metal may be used such as, for example, stainless steel or galvanized steel, where when enclosed, the device (20, 60) remains buoyant. The device (20, 60) may also be constructed of any combination of these materials. Additionally, the device (20, 60) may be equipped with a buoyant material (e.g. a float) to ensure buoyancy.

Typically, for example as shown in FIGS. 2A, 3, 4, 8 and 11, the containment end (22) comprises a compartment or storage area (23) defined by a sidewall(s) (24) and a base wall (25) having both inner (26) and outer (27) surfaces. The compartment (23) preferably has a storage volume that allows for containment of the drainage plug (50), however storage areas that allow for the drainage plug and/or extraneous items such as, for example, an extra boat key, are also contemplated to be within the scope of the embodiments of the present invention. Such parameters and measurements are well known to those skilled in the art.

Figure 8:
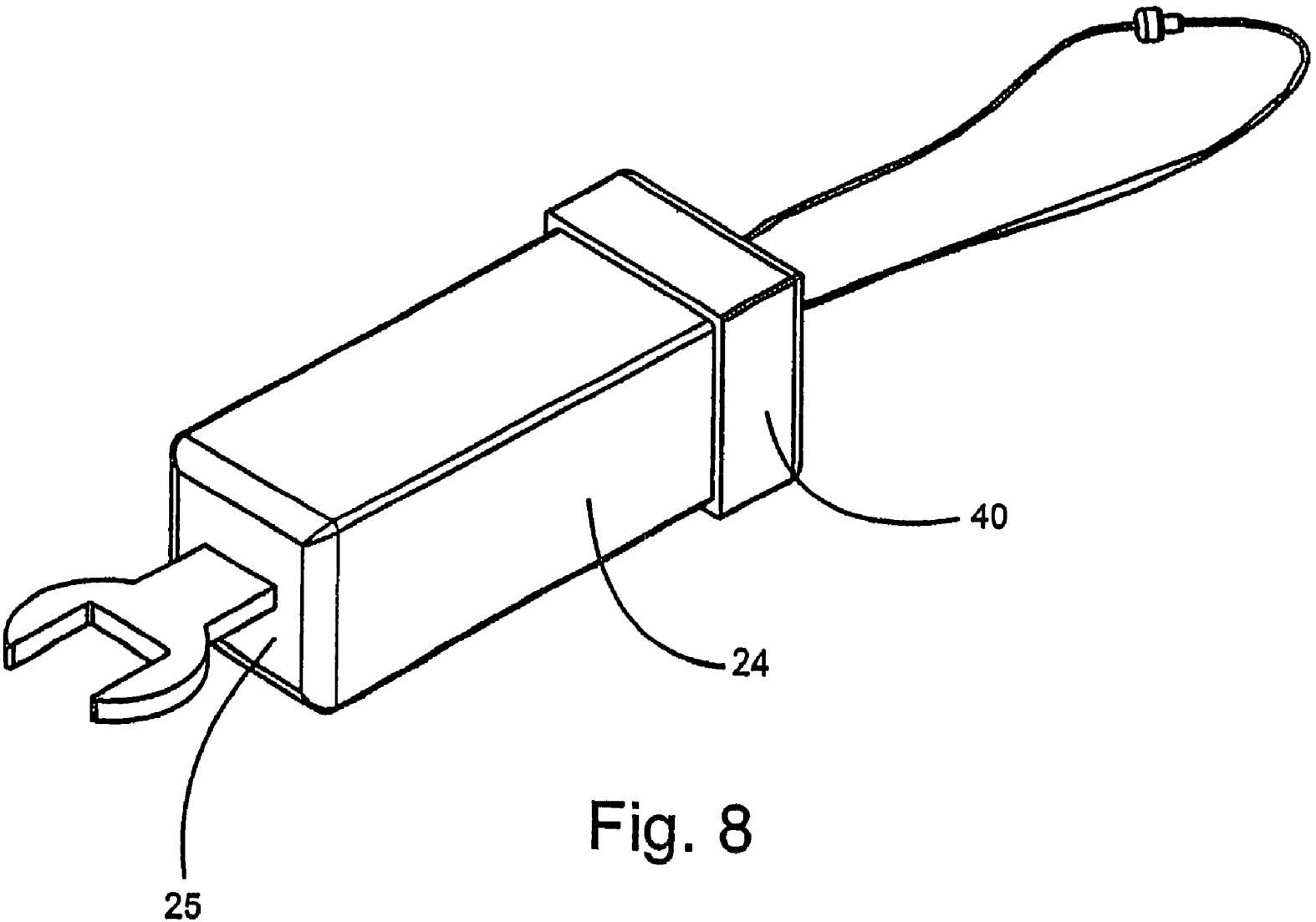
FIG. 8 is a perspective view of an alternate embodiment of the present invention.

The embodiments of the containment end (22) of the present invention may have any configuration including, but not limited to, rectangular (e.g. as shown in FIG. 8), triangular, octagonal or hexagonal (all of which may prevent rolling if dropped in the boat) as well as cylindrical (e.g. as shown in FIG. 1).

Figure 9:
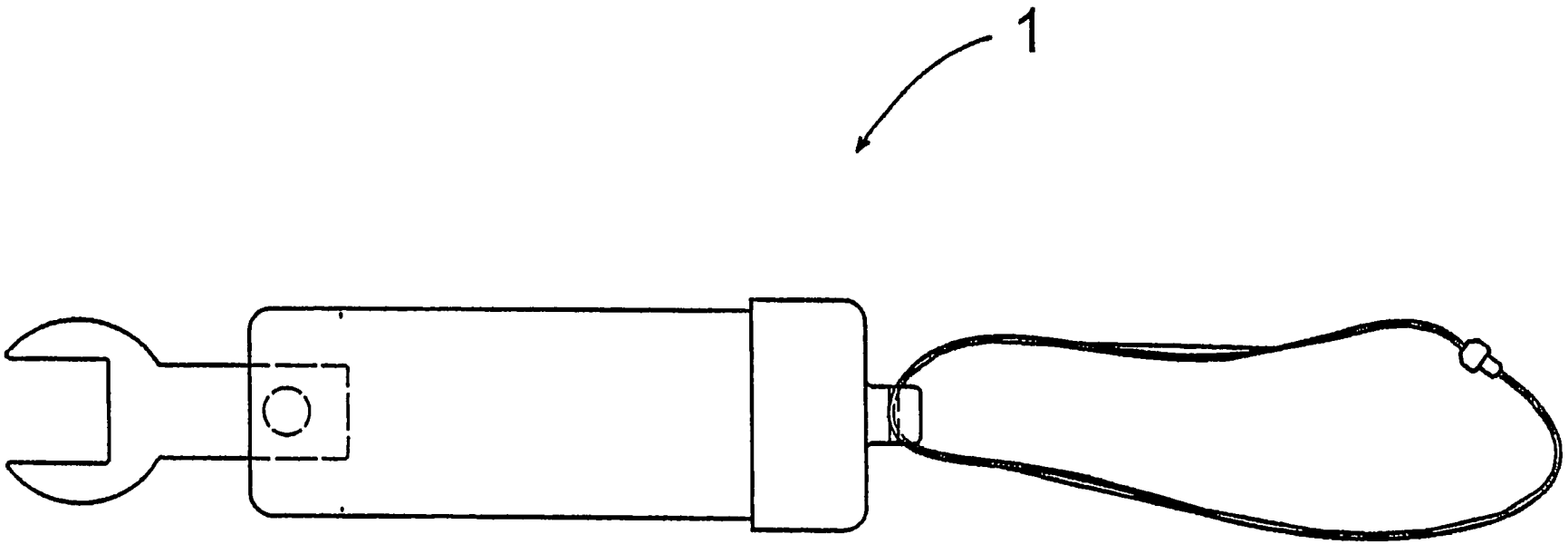
FIG. 9 is a side view of an alternate embodiment of the present invention.

As shown in FIGS. 1-5, the tool-receiving end (30) comprises a tool-support (31) extending away from the base wall (25) in the direction of the major axis of the tool, wherein the tool-support (31) has a cavity (32) capable of accepting the proximal end (12) of the tool (10). The cavity (32) may extend through only a portion of the tool-support (31), a substantial portion of the tool support (31) or through the tool-support (31) where the cavity (32) extends to the base wall (25). The cavity (32) may be of a configuration that is complimentary to the proximal end (12) of the tool (10) (e.g. to form the molded pin snap as shown in FIG. 11). Alternatively, the tool-support (31) may be the base wall (25), such that it may be of a thickness to allow insertion of the proximal end (12) of the tool (10) into the base wall (25) while not compromising the buoyancy of the tool assembly (1) due to leakage (e.g. FIGS. 8 and 9). Alternatively, another embodiment of the present invention contemplates a configuration where the tool comprises the both the tool and the tool-support where they are formed as a unitary structure. For example, the tool-support and tool may both comprise a plastic such that they may be formed as a single piece. Thus, in any configuration described herein, the tool-support (31) assists in positioning the tool (10) and in providing structural integrity and torsional support during normal use of the tool assembly (1).

As noted above, preferably the tool-receiving end (30) is coupled with the tool (10) using a molded pin snap, whereby the cavity's surface (33) comprises a protrusion (34), which is of a size and positioning to mate with the aperture, depression or other type of indentation (13) found on the tool (10), thereby preventing the tool (10) from falling out of the device (20) should it be dropped during use.

Typically the compartment or storage area (23) of the containment end (22) is enclosed using an enclosing device (40) (some examples of which are shown in FIGS. 1, 2A, 3, 4 and 8), wherein it may be removeably attached to the containment end (22). Removeable attachment may be enabled by those methods known within the art such as, for example, where both the enclosing device (40) and containment end (22) are threaded or where the enclosing device (40) snaps onto the containment end (22). Preferably, with respect to the embodiment of the present invention capable of floating, the containment end (22) and enclosing device (40) are removeably attached to one another to form at least a water-tight, more preferably an air tight seal, thereby further preserving the contents, particularly when extraneous items of a corrodible nature (for example a key) are contained therein. Moreover, the water-tight, and preferably air-tight, seal enhances the preferred floating capabilities of the tool assembly (1). The enclosing device (40) may be substantially solid, so long as when it is used in conjunction with a floating embodiment it does not compromise the floating capabilities of the present invention. Alternatively, the enclosing device (40) may be hollow and thereby increase the overall compartment size, such that items that may be larger than the containment end (22) can be contained within the various embodiments of the present invention. The enclosing device (40) may generally be of any configuration so long as it is capable of providing the necessary seal between itself and the containment end.

The enclosing device (40) for the containment end (22) of the device (20, 60) may be any means known in the art including, but not limited to, threaded caps or lids, snap-on caps or lids and the like.

The enclosing device (40) may further comprise an orifice (41) through which an attachment device (42) is threaded, wherein the attachment device (42) includes, but is not limited to, a string, rope, band (i.e. plastic or rubber) or chain. Thus, an embodiment of the present invention may serve as a key chain or may be further secured to a person, boat or other item.

In another embodiment the enclosing device (40) may be attached to or comprise an alerting device such as, for example, a sound-emitting device (for example, a whistle), a light (for example, a blinking light), or a combination thereof.

Optionally, the device (20, 60) may comprise a plurality of protrusions (65) which extend longitudinally from the proximal end to the distal end to aid the user in gripping the device (20, 60) and/or the enclosing device (40) for rotational movements to, for example, functionally engage the drainage plug or open or close the containment end (22). In a preferred embodiment, the device (20, 60) comprises a plurality of protrusions that extend from substantially from the proximal end to the distal end (in unitary devices), or substantially from the proximal end to a point before the enclosing device (in two-piece devices). In two-piece devices, the enclosing device (40) preferably comprises a plurality of protrusions (66) that extended longitudinally from the point of connection (of the enclosing device to the body of the device) to substantially the distal end of the device.

What is claimed is:

1. A device for engaging a boat drainage plug comprising: a body having a proximal end and a closed distal end opposite said proximal end; and disposed in the proximal end, a socket capable of functionally engaging a boat drainage plug; wherein said distal end comprises a containment end and an enclosing device for the containment end; wherein said device is constructed of a material capable of providing the structural rigidity necessary to withstand the stresses encountered during normal insertion and removal of a boat drain plug; wherein said device comprises plastic, wood, or a combination thereof; and wherein said device floats when placed in water.

2. The device of claim 1, wherein the proximal end is substantially blunt.

3. The device of claim 1, wherein the device comprises polyvinyl chloride plastic.

4. The device of claim 1, wherein the device comprises teak wood.

5. The device of claim 1, wherein the containment end comprises a compartment end, which comprises a compartment defined by at least one sidewall and a base wall having an inner surface and an outer surface.

6. The device of claim 1, wherein the enclosing device is attached to a whistle, a light, or a combination thereof.

7. The device of claim 1, wherein the enclosing device comprises a whistle, a light, or a combination thereof.

8. The device of claim 1, wherein the shape of the socket is substantially square.

9. The device of claim 8, wherein the width of the socket is $9/16^{th}$ of an inch.

10. The device of claim 1, wherein an orifice is disposed on the distal end.

11. The device of claim 1, wherein the proximal end is substantially blunt; wherein said containment end comprises a compartment defined by at least one sidewall and a base wall having an inner surface and an outer surface; wherein the shape of the socket is substantially square and the width of the socket is about $9/16^{th}$ of an inch; and wherein an orifice is disposed on the distal end.

12. A device for engaging a boat drainage plug comprising: a body having a proximal end and a closed distal end opposite said proximal end; and disposed in the proximal end, a socket capable of functionally engaging a boat drainage plug; wherein said device is constructed of a material capable of providing the structural rigidity necessary to withstand the stresses encountered during normal insertion and removal of a boat drain plug; wherein said device comprises plastic, wood, or a combination thereof; wherein said device has a water buoyancy that is greater than its weight; wherein the proximal end is substantially blunt; wherein the distal end comprises a containment end and an enclosing device for the containment end, said containment end comprising a compartment defined by at least one sidewall and a base wall having an inner surface and an outer surface; wherein the shape of the socket is substantially square and the width of the socket is about $9/16^{th}$ of an inch; and wherein an orifice is disposed on the distal end.

* * * * *